US005375883A

United States Patent [19]

Wyant

[11] Patent Number: 5,375,883

[45] Date of Patent: Dec. 27, 1994

[54] PORTFOLIO INCLUDING DETACHABLE WALLET MEMBER

[75] Inventor: Jon R. Wyant, Spring Valley, Ohio

[73] Assignee: The Mead Corporation, Dayton, Ohio

[21] Appl. No.: 132,504

[22] Filed: Oct. 5, 1993

[51] Int. Cl.[5] ..... B42D 3/00

[52] U.S. Cl. ..... 281/37; 281/29; 281/51; 402/4; 402/80 R

[58] Field of Search ..... 281/29, 31, 37, 51; 402/79, 80 R, 4

[56] References Cited

U.S. PATENT DOCUMENTS

| | | | |
|---|---|---|---|
| D. 253,438 | 11/1979 | Markley | D3/76 |
| D. 294,282 | 2/1988 | Hung | D19/88 |
| 3,866,751 | 2/1975 | Holert | 281/31 X |
| 4,224,675 | 9/1980 | Pinkerman | 364/705 |
| 4,308,951 | 1/1982 | Walker, Jr. | 206/214 |
| 4,832,191 | 5/1989 | Gerver et al. | 281/51 X |
| 4,961,596 | 10/1990 | Moor | 281/31 X |
| 4,964,508 | 10/1990 | Balsley | 281/31 X |
| 5,048,869 | 9/1991 | Schwartz | 281/16 |
| 5,058,736 | 10/1991 | Bedol | 206/214 |
| 5,232,301 | 8/1993 | Bianco | 281/29 X |

*Primary Examiner*—Willmon Fridie

*Attorney, Agent, or Firm*—Thompson, Hine and Flory

[57] ABSTRACT

This invention relates to a portfolio having a detachable walled member and, more particularly, a wallet member containing an electronic computing device or radio slidably secured in a pocket in the portfolio such that the wallet member can be rotated to a position outside the perimeter of the portfolio or detached from the portfolio for use. The electronic computing device contained in the walled member is preferably a calculator.

14 Claims, 1 Drawing Sheet

FIG.1
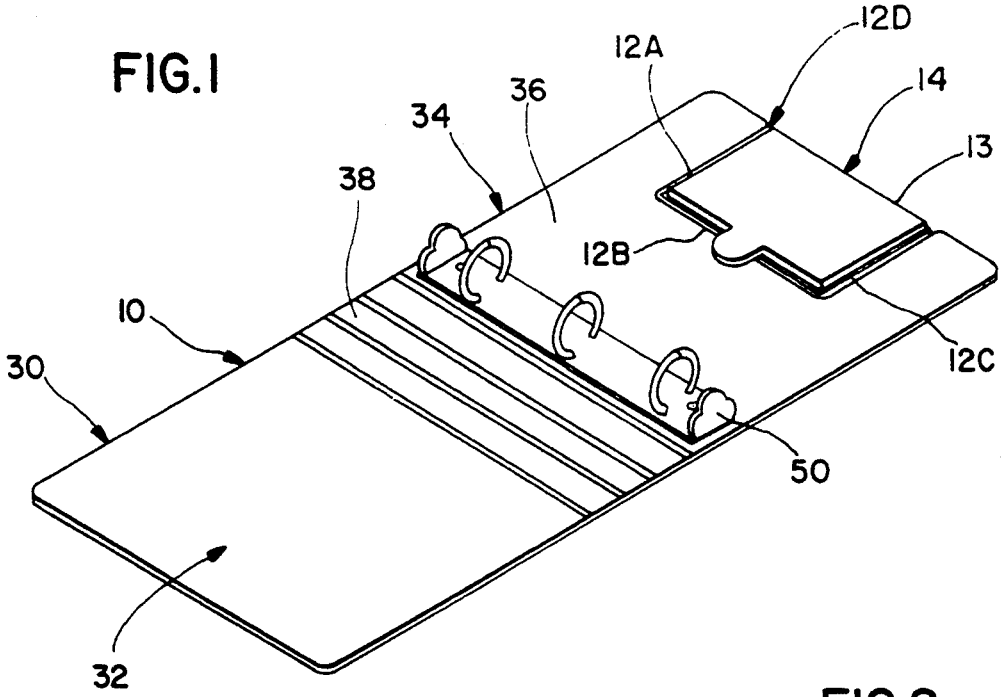
FIG.2
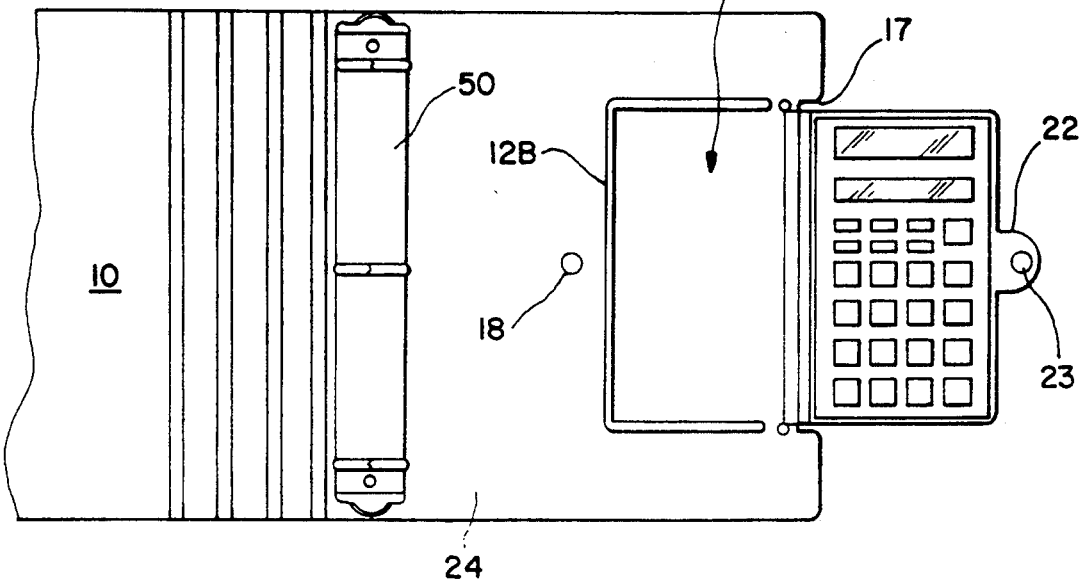
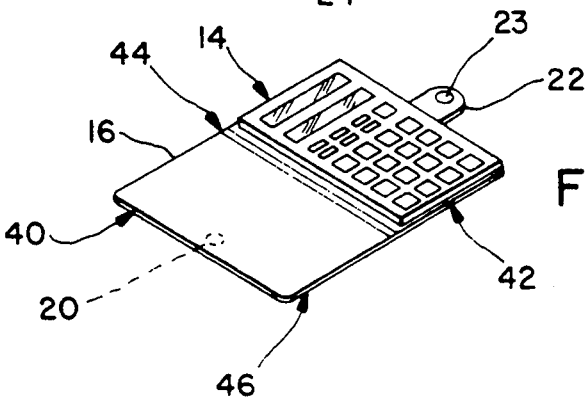
FIG.3

PORTFOLIO INCLUDING DETACHABLE WALLET MEMBER

BACKGROUND

This invention relates to a portfolio having a detachable wallet member and, more particularly, a wallet member containing an electronic computing device or radio slidably secured in a pocket in the portfolio such that the wallet member can be rotated to a position outside the perimeter of the portfolio or detached from the portfolio for use. The electronic computing device contained in the wallet member is preferably a calculator.

It is known in the art to provide a portfolio having a calculator associated therewith. However, previous calculator portfolios have not been convenient to use. If the calculator is mounted on the front cover of the portfolio, the portfolio must be closed to use the calculator. If the calculator is mounted on the inside back cover of the portfolio, it interferes with using the inside back cover as a writing surface. If the calculator is provided on the inside front cover, it may be covered by the pages which are turned toward the front cover as the portfolio is used. Thus, there is a need for an improved calculator-portfolio design.

SUMMARY OF THE INVENTION

This invention provides a portfolio having a detachable wallet member and, more particularly, a wallet member containing an electronic calculating device which preferably is a calculator or radio. The wallet member is mounted within the portfolio so that the wallet member may be opened to a position outside the perimeter of the portfolio or the wallet member may be removed from the portfolio and used separately. In a preferred embodiment, the wallet member contains an electronic computing device. This electronic computing device can be a calculator, a scientific calculator or a spelling checking device. In place of an electronic computing device, the wallet member may also contain a radio. In a more preferred embodiment the electronic computing device is a calculator or a scientific calculator.

The portfolio contains a pocket adapted to receive the front flap of the wallet member so that the wallet member can be contained within the binder. In order to secure the wallet member within the portfolio, the wallet member contains a pair of closure elements, one of which is adapted to mate with a closure element located on the inside of the portfolio. When the wallet member is detached from the portfolio, the pair of closure elements contained on the wallet member mate with each other to secure the wallet member in a closed position detached from the portfolio. Thus, there is provided a convenient means of using and storing the wallet member together with or apart from the portfolio.

BRIEF DESCRIPTION OF THE DRAWINGS

FIG. 1 is a perspective view of a preferred embodiment of this invention in which the portfolio of the invention in an open position having a wallet member containing a calculator detachably mounted on its inside surface;

FIG. 2 is a top plan view of the preferred embodiment of the portfolio of the invention showing the wallet member containing the calculator rotated outside the perimeter of the portfolio; and FIG. 3 is a perspective view of the wallet member of the invention containing a calculator.

DETAILED DESCRIPTION OF THE INVENTION

Portfolio 10 consists of front portfolio cover 30 and back portfolio cover 34 attached to each other by means of a spine 38. The covers are formed by leaf boards which are covered with a conventional fabric or plastic material such as cloth or vinyl. On its back inner surface 36, the portfolio includes a pocket 12. The pocket 12 is closed on three of its four sides 12A, 12B and 12C. It is open on a fourth side 12D parallel to the outside back edge of the portfolio 10. On the side opposite the opening 12D in close proximity to side 12B, a fastening means 18 is secured to the binder. The portfolio 10 may also include a three ring binder 50 located on either its front inner surface 32, its back inner surface 36, or the spine 38. As illustrated in FIGS. 1 and 2, the three ring binder 50 is located on the back inner surface 36. In a typical embodiment, the leaf boards are covered with a vinyl plastic and the pocket 12 is formed by heat sealing a rectangular member to the backside of the vinyl sheet on the inside surface of the back cover along sides 12A, 12B, and 12C. The back leaf board preferably includes a cut out 17 along its outer edge such that the wallet member does not extend substantially beyond the edge of the portfolio 10 when the portfolio is closed.

The wallet member 16 includes a front wallet cover 40, a back wallet cover 42, and a spine 44. The wallet member 16 further includes two fastening means, one, fastening means 20, on the outer surface 46 of the front wallet cover 40 and the other 23 located on tab 22. Fastening means 20 and 23 are the same type as the means 18 located on the portfolio. The fastening means may be any type of conventional fastening means such as press tabs, snaps, magnets or a hook and loop fastener and, in the preferred embodiment, the fastening means are either magnets or a hook and loop fastener such as VELCRO ®. The wallet is made of conventional materials commercially available in the art.

The wallet member 16 can be releasably secured within the pocket 12 of the portfolio 10. The front wallet cover 40 of the wallet member 16 slides into the pocket 12. With front wallet cover 40 inserted into the pocket 12, the calculator may be closed by securing fastener 23 to fastener 18 or the wallet member 16 may be opened so that the calculator 14 lays outside the perimeter of the portfolio 10.

The fastening means on the wallet member 20 and 23 are further adapted such that they can effect closure of the wallet member 16 apart from the portfolio 10. This then allows one to use the wallet member 16 separate from the portfolio 10.

In a preferred embodiment, the wallet member 16 can contain an electronic computing device 14 or a radio (not shown). The preferred electronic computing device employed in this invention is a calculator, however, one skilled in the art will appreciate that other electronic devices may be employed. For example, the portfolio may instead include a scientific calculator, a spell checker or a radio or other similar articles. Furthermore, in another embodiment, the wallet member 16 may be used as a personal wallet to contain money, pictures, or other personal effects.

While the invention has been illustrated using an embodiment in which the wallet member 16 is provided on the inside back portfolio cover 36, a less preferred embodiment is also possible in which the wallet member 16 is provided on the inside front portfolio cover 32. In this case, the wallet member 16 should contain the electronic computing device or radio inside the front wallet cover 40 of the wallet member 16 instead of inside the back wallet cover 42 as depicted in FIG. 3.

One skilled in the art will appreciate that the present invention can be practiced by other than the described embodiments, which are presented for purposes of illustration and not for limitation, and it will be apparent that modification and variations are possible without departing from the scope of the invention defined in the appended claims.

What is claimed is:

1. A portfolio comprising:

a portfolio having an inside surface and an outside surface, said portfolio further having a front portfolio cover and a back portfolio cover spaced from and hinged to one another by a spine;

a wallet member having a front wallet cover and a back wallet cover spaced from and hinged to one another by a spine; and a pocket adapted to receive, slidably and detachably, said front wallet cover or said back wallet cover, said pocket located on said inside surface of said front portfolio cover or said back portfolio cover and being positioned such that by opening said wallet member, said front wallet cover or said back wallet cover not received in said pocket rotates about an axis parallel to the outside edge of said front or back portfolio cover to a position immediately outside the perimeter of said portfolio.

2. The portfolio of claim 1 further including a first fastening means on said back portfolio cover or said front portfolio cover adjacent said pocket and a second fastening means on said back wallet cover or said front wallet cover adapted to mate with the first fastening means to secure the wallet member in the portfolio.

3. A portfolio comprising:

a portfolio having an inside surface and an outside surface, said portfolio further having a front portfolio cover and a back portfolio cover spaced from and hinged to one another by a spine;

a wallet member having a front wallet cover and a back wallet cover spaced from and hinged to one another by a spine;

a pocket adapted to receive, slidably and detachably, one of said front wallet cover or said back wallet cover, said pocket located on said inside surface of said front portfolio cover or said back portfolio cover and being positioned such that by opening said wallet member, said front wallet cover or said back wallet cover not received in said pocket rotates about an axis parallel to the outside edge of said front or back portfolio cover to a position immediately outside the perimeter of said portfolio;

a first fastening means on said front portfolio cover or said back portfolio cover adjacent said pocket; and a second fastening means on said front wallet cover or said back wallet cover adapted to mate with the first fastening means to secure the wallet member in the portfolio.

4. The portfolio of claim 1 wherein said wallet member further includes a third fastening means which is adapted to mate with both said first fastening means and said second fastening means.

5. The portfolio of claim 1 wherein the fastening means are hook and loop fasteners.

6. The portfolio of claim 3 wherein an electronic computing device is positioned on the back cover of said wallet member and said pocket is located on the inside surface of the back cover of said portfolio.

7. The portfolio of claim 6 wherein the portfolio includes a three ring binder.

8. The portfolio of claim 7 wherein the three ring binder is secured to the inside surface of the back portfolio cover.

9. The portfolio of claim 6 wherein the wallet member includes an electronic computing device selected from the group consisting of a calculator, a scientific calculator, and a spelling checking device.

10. The portfolio of claim 9 wherein the electronic computing device is a calculator.

11. The portfolio of claim 9 wherein the electronic computing device is a scientific calculator.

12. The portfolio of claim 9 wherein the electronic computing device is a spelling checking device.

13. The portfolio of claim 6 wherein the wallet member includes a portable radio.

14. The portfolio of claim 1 wherein an electronic computing device is positioned on the back cover of said wallet member and said pocket is positioned on the back cover of the portfolio.

* * * * *

UNITED STATES PATENT AND TRADEMARK OFFICE

CERTIFICATE OF CORRECTION

PATENT NO. : 5,375,883
DATED : December 27, 1994
INVENTOR(S) : Jon R. Wyant

It is certified that error appears in the above-indentified patent and that said Letters Patent is hereby corrected as shown below:

Column 4, claim 4, line 1, change "1" to --3--.
Column 4, claim 5, line 1, change "1" to --3--.

Signed and Sealed this

Twenty-eight Day of March, 1995

*Attest:*

Bruce Lehman

BRUCE LEHMAN

*Attesting Officer*

*Commissioner of Patents and Trademarks*